United States Patent [19]

Stoev et al.

[11] 4,109,874

[45] Aug. 29, 1978

[54] APPARATUS FOR MINERAL PROCESSING

[75] Inventors: Stoycho Mitrev Stoev; Ivan Mitrev Sapunarov; Emil Nikolov Manov, all of Sofia, Bulgaria

[73] Assignee: Vish Minno-Geloshki Institute-Nis Darvenitza, Darvenitza, Bulgaria

[21] Appl. No.: 715,635

[22] Filed: Aug. 18, 1976

Related U.S. Application Data

[63] Continuation-in-part of Ser. No. 572,456, Apr. 28, 1975, abandoned.

[51] Int. Cl.[2] ..... B02C 23/36

[52] U.S. Cl. ..... 241/69; 209/12; 209/168; 241/175

[58] Field of Search ..... 209/166, 167, 162, 164, 209/168–170, 213, 12; 241/20, 24, 184, 68, 69, 175

[56] References Cited

U.S. PATENT DOCUMENTS

| | | | |
|---|---|---|---|
| 1,521,277 | 12/1924 | Christensen | 209/169 |
| 1,700,667 | 1/1929 | Bues | 241/184 |
| 1,807,383 | 5/1931 | Carnahan | 241/184 |
| 1,910,386 | 5/1933 | Garrett | 209/168 X |
| 1,958,035 | 5/1934 | De Coursey | 209/169 X |
| 2,122,217 | 6/1938 | Sisson | 241/20 X |
| 2,274,904 | 2/1942 | Drumgold | 209/168 X |
| 2,982,485 | 5/1961 | Fuhrenwald | 241/175 |
| 3,084,876 | 4/1963 | Podmore | 241/175 X |
| 3,405,972 | 9/1969 | Ardary | 241/69 |
| 3,545,088 | 12/1970 | Oshima | 241/69 |

FOREIGN PATENT DOCUMENTS

| | | | |
|---|---|---|---|
| 1,252,153 | 10/1967 | Fed. Rep. of Germany | 209/168 |

OTHER PUBLICATIONS

Mining Congress Journal, Jun. 1967, 43, 49, 50, 52, 54.

*Primary Examiner*—Robert Halper

[57] ABSTRACT

Apparatus for processing ore by a combined milling, froth flotation and size classifying operation, wherein A milling chamber contains elastomeric milling bodies situated between first and second screens. The milling chamber is provided with an agitating means for vertical vibration of the milling bodies. A first outlet on the milling chamber removes froth. A second outlet below the first and lowermost screen removes the coarser components.

2 Claims, 4 Drawing Figures

APPARATUS FOR MINERAL PROCESSING

CROSS-REFERENCE TO RELATED APPLICATION

This application is a continuation-in-part application of our copending application Ser. No. 572,456, filed Apr. 28, 1975, now abandoned.

This invention relates to an apparatus for the processing of minerals. More particularly, minerals are simultaneously subjected in a single working cell to milling and flotation processes.

It is already known to mill and then float ores in separate successive processes. The treatment of ores in such manner entails a number of disadvantages: The sliming of the components, which causes large losses of mineral, the unnecessary milling of the gangue material, and increased, unnecessary energy costs. The application of gradual milling and further mineral processing leads to even greater expense.

Different constructions are known for apparatus carrying out the steps of milling and subsequent flotation of ores, but, as set forth above, they carry out such two methods separately. In some countries, for example at the "Kotlyakov" Soviet mill and at the Danver Company in America, single cells are employed which are used for the process of milling and for flotation of coarse ground material.

The disadvantages of such well-known constructions are as follows:

These constructions require the use of two or more apparatus units, and also require expensive maintenance because of the fast wearing out of certain of the parts of such apparatus, including the clogging of the apparatus with mineral ore material, etc.

The present invention provides an integral apparatus precluding sliming to produce useful minerals, because the flotation and gravitational separation produced by the apparatus of the invention takes place simultaneously with the milling of the material.

The principal object of the apparatus is the integration of the milling and flotation processes. Material fed into the working cell at one end thereof moves to the opposite end thereof while being subjected to continuous milling by vibratory milling bodies. At the same time, air is continuously introduced into the working cell to form a source of bubbles.

In this vibrating medium the bubbles constantly strive to float up to the top carrying with them the adhered particles of floatable material on their surfaces, such floatable material having been liberated during the milling of the ore. As a result of vibration of the milling bodies and the pulp, the introduced air is finely dispersed and the bubbles thus produced are distributed uniformly.

In preferred embodiments of the apparatus in accordance with the invention, a working cell is mounted upon a fixed supporting structure by elastic supports, the working cell being driven in forced oscillation by a pair of vibrators which preferbly impart a vertical linear vibration to the material in the working cell. The working cell is filled with a definite volume of milling bodies, and a screen is mounted above the milling bodies. Air supply pipes pass into the cell at a number of spaced locations, such pipes passing through the screen. Material feeding and discharging chutes or troughs are mounted on the cell. An ore supporting screen can be mounted at the bottom of the cell.

The milling bodies can be made of elastic material, such as, for example, rubber to effect a certain type of milling (when brittle materials are processed, rubber milling bodies are used).

The working cell may be operated wet, in which case water is supplied to it. If a certain type of ore is processed, certain types of particles of the ore itself perform a self-milling operation on some of the other ingredients of the processed ore.

A vertical-linear vibration of the working cell favors a simultaneous milling and flotation process. These types of vibrations are obtained by using two motor-vibrators which are mutually synchronized in such a way that their resepective horizontal vibrating forces cancel each other out and their respective vertical vibrating forces are additive. If only a single vibrator is used, it should preferably be of the electromagnetic type. It has been observed that when the working cell is not subjected to a primarily vertical vibration, the ore material in the working cell performs at least partially a rotary vibrating movement which impedes the separation of certain types of minerals.

If the working cell is to perform a separation primarily by gravitational classification, it is formed as a closed container so as to reduce the spread of dust. The air supply pipes then suck out a predetermined range of sizes of particles from the working cell by applying a vacuum pressure therethrough. The coarser particles of the milled ore are then removed through a bottom outlet of the working cell after they have passed through a horizontal screen mounted in the lower part of the working cell.

It has been noted that the self-milling of certain ores is promoted by adjusting the vibrators so that horizontal vibrating forces do not cancel each other out and do impart consequently a rotary-vibratory motion to the particles in the working cell so that the particles strike each other and disintegrate.

The accompanying drawings show four illustrative preferred embodiments of the apparatus of the invention. In the drawings:

FIG. 5 is a schematic view in vertical longitudinal section through a third illustrative embodiment of the apparatus of the invention which performs a dry classification;

FIG. 6 is a view in vertical transverse section through the apparatus of FIG. 5, the section being taken along the line A—A of FIG. 5;

FIG. 7 is a schematic view in vertical longitudinal section through a fourth illustrative embodiment of the apparatus of the invention which performs a wet milling operation; and FIG. 8 is a schematic view in vertical transverse section through the apparatus of FIG. 7 along the line A—A of FIG. 7.

Figures 1, 2:
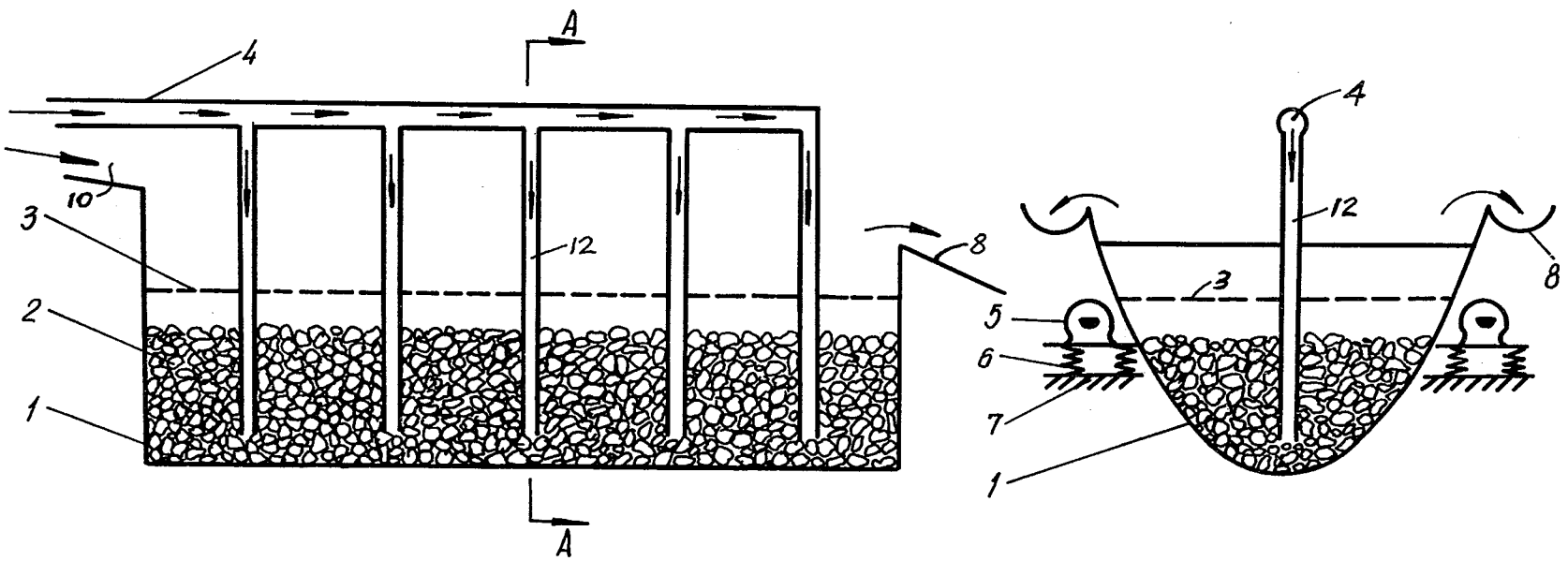
FIG. 1 is a schematic view in vertical longitudinal section through a first illustrative embodiment of the apparatus of the invention.
FIG. 2 is a view in vertical transverse section through the apparatus of FIG. 1, the section being taken along the line A—A of FIG. 1.

Turning now to the drawings and specifically to FIGS. 1 and 2 thereof, a working cell 1 has the bottom thereof filled with milling bodies 2. A horizontal screen 3 spans the cell between the opposite sides thereof and is disposed some distance above the top of the milling bodies 2. Ore in particulate form to be milled is introduced into the working cell 1 through a chute 10. The thus-introduced ore falls upon the screen 3 and thence the particles below a predetermined size fall through the openings in the screen to be distributed throughout the mass of the milling bodies 2.

Air is introduced throughout the mass of milling bodies and particulate mineral ore to be processed through an air conduit 4 in the form of a manifold from which there descend a plurality of pipes 12 which are spaced along the length of the cell. The pipes 12 have preferably perforations along their length. The lower ends of the pipes 12 terminate somewhat above the bottom of the cell. A flotation liquid is also introduced into the cell through the chute 10, the liquid filling the lower part of the cell up to a height slightly below the peaks of discharge chutes or troughs 8.

The working cell 1 and the milling bodies 2, and the particulate ore material therein, as well as the flotation liquid, are subjected to vibratory oscillation by means of vibrators 5 secured to the outer wall of the cell 1 as shown in FIG. 2, the cell being mounted upon a fixed foundation or chassis 7 by means of coil compression springs 6 disposed between the foundation 7 and wings extending from the sides of the cell upon which the vibrators 5 are mounted. The vibrators 5 are preferably of a known construction and can be adjusted so that they impart to the cell 1 vibrations primarily in a vertical direction depending on the ore to be processed. Such vibrators may employ, for example, a driven shaft journalled in a structure secured to the cell 1, there being an eccentrically disposed weight secured to the shaft.

After the cell 1 has been charged with milling bodies 2, particulate mineral ore, the flotation liquid, the vibrators 5 are switched on. Air is supplied to the mass of the milling bodies 1 and of the particulate ore material through the manifold conduit 4 and the downwardly extending pipes 12. With the switching on of the vibrators 5, the cell 1 is placed in oscillating movement so that vibratory milling of the particulate ore material begins. Air entering the cell through the manifold 4 and the pipes 12 form bubbles in the flotation liquid in the cell 1, the bubbles rising through the mass of milling bodies 2, the particulate ore, and the flotation liquid. The finely dispersed bubbles which finally reach the discharge chutes or troughs 8 carry with them adhered particles of floatable components of the ore on their surfaces. The vibration of the milling bodies accomplishes a fine dispersion of the in-fed air, and thus a uniform production of bubbles throughout the mass of milling bodies and particulate ore. The grid or screen 3 attenuates the area where the simultaneous milling and flotation occurs. The non-flotatable material is discharged through a non-illustrated discharge chute.

The device can also be used as a dry gravitational classifier in which case the tubing 12 would be perforated and used to suck the air out. The working cell 1 should be closed to avoid the spreading of dust. If the classification is to be wet, the tubing 12 would be omitted.

Figure 4:
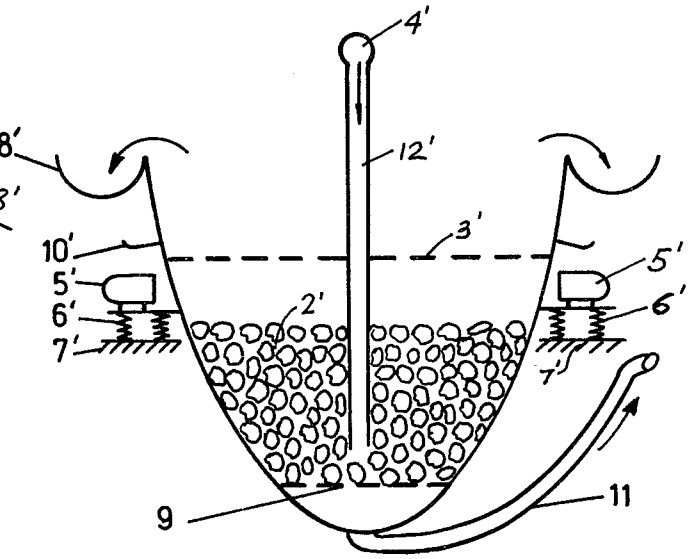
FIG. 4 is a view in transverse vertical section through the apparatus of FIG. 3, the section being taken along the line B—B of FIG. 3.
Figure 3:
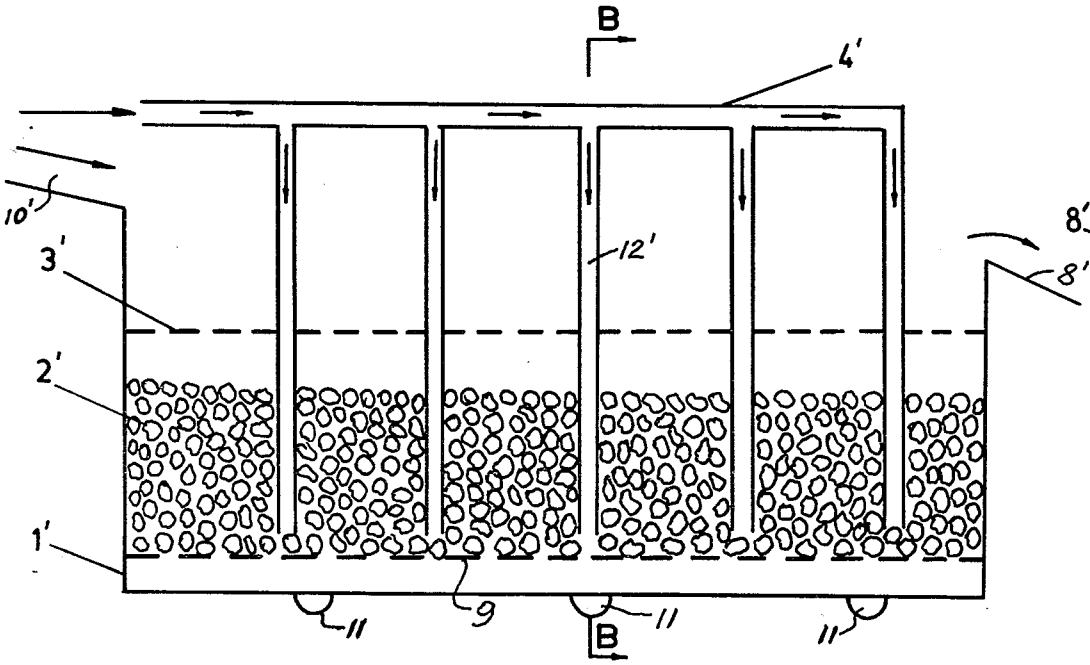
FIG. 3 is a schematic view in vertical longitudinal section through a second illustrative embodiment of the apparatus in accordance with the invention adapted to carry out a combined milling, flotation and gravitational enriching.

As above indicated, FIGS. 3 and 4 show a second preferred embodiment of the apparatus of the invention. Elements of the apparatus which are similar to those shown in FIGS. 1 and 2 are designed by the same reference characters but with an added prime (′).

The apparatus of FIGS. 3 and 4 differs from that of FIGS. 1 and 2 by the use of a second, ore screen or grid 9 disposed somewhat above the bottom of the working cell 1′ and supporting the entire mass of milling bodies 2′. The space in the cell 1′ beneath the screen or grid 9 is connected to a plurality of longitudinally spaced conduits 11 through which heavier fractions of the ore may be discharged. The floatable components are discharged via the troughs 8′ and somewhat heavier components via troughs 10′. The ore is fed in via the chute 10*a*. This device is particularly well adapted to process ores having differently sized particles and can perform three different processes simultaneously, namely, grinding, gravity separation and flotation separation.

The apparatus of FIGS. 5 and 6 differs from that of FIGS. 1 and 2 in that the milling bodies are made of an elastic material such as rubber. The elements of the apparatus of FIGS. 5 and 6 which are similar to those shown in FIGS. 1 and 2 are designated by the same reference characters with an added prime (″).

The device of FIGS. 5 and 6 is adapted to carry out a dry classification. The air is sucked out of the working cell 1″ be means of the pipe conduits 4″ which have perforations in their vertical portions.

There is illustrated in FIGS. 7 and 8 a fourth embodiment of the apparatus of the invention. This apparatus is adapted for carrying out a wet milling operation. In this device the elements which are similar to those shown in FIGS. 5 and 6 are designated with the same reference characters with an added prime (′). In this device the shaft of the motor vibrators 5‴ are adjusted so that they rotate in the same direction and the material in the working cell 1‴ is therefore subjected to a rotary-vibratory motion. In this device the ore in the working cell 1‴ performs a self-milling operation. In such a self-milling process, the vibrations imparted to the particles cause them to strike each other and to thereby disintegrate.

There follow now a plurality of examples illustrating the mode of operation of the devices of the invention.

EXAMPLE 1

Kaolin ore is to be processed. This ore contains the minerals kaolinite and quartz. If the vibrating device of this invention were to include steel balls as milling bodies, the kaolinite would be milled jointly with the quartz which would hamper the separation of these minerals by flotation or classification in the same chamber. In such a case, the kaolinite product would inevitably be polluted by small sand particles. Such an ore is therefore milled by a self-milling process, that is, where the particles of ore themselves produce the milling. Alternatively, the working cell may have elastic milling bodies (for example rubber balls) which would bring about a milling of the kaolinite particles only while the sand particles will keep their size. Such a milling will then permit an easier separation of the milled particles.

EXAMPLE 2

Pyrite ore having particle sizes between 6–0 mm is processed in the device illustrated in FIGS. 3 and 4. The milling effects a freeing of small pyrite particles which can then be separated by flotation. The foam having the small pyrite particles is discharged through the discharge troughs 8''. Larger and smaller particles can also be separated from the pyrite rock. The larger rock particles, being lighter than the milling bodies, can be discharged through the discharge troughs 10'. In such a milling operation, three different processes take place, namely grinding, gravity separation and flotation separation.

EXAMPLE 3

Large-sized swollen perlite particles having a particle size up to 5 mm and having a bulk weight of 82 $Kg/M^3$ are to be milled down to a particle size of 80 microns and a maximum bulk weight of 150 $Kg/M^3$. In this case, if steel balls or other hard milling bodies are used in the device of the invention, then the structure of the swollen perlite particles is destroyed and the fine material reaches a bulk weight in excess of 250 $Kg/M^3$ density. However, if the milling is performed with elastic bodies which ensure a "soft" milling, then the changing of the inner structure of the particles is such that the fine material obtained has a density and bulk weight of less than 120 $Kg/M^3$.

EXAMPLE 4

Phosphor ore of the oolite type where the oolites are combined with clay is fed into a vibrating cell in accordance with this invention. There the particles of the ore collide with elastic milling bodies, such as rubber balls. The collision forces suffice to destroy or disintegrate the clay of the ore but do not substantially affect the integrity of the phosphor oolite particles. As a result, the clay is converted into a fine dust which can be removed by flotation and the phosphor oolite particles are removed as a concentrate at the end of the vibrating operation. The orginal phosphor oolite ore has a content of 13.2 wt % of $P_2O_5$. From this ore there is extracted a concentrate having 29.8 wt % of $P_2O_5$ wherein the overall extraction of the ore amounts to 90.5 wt %. The milling bodies consist of rubber balls having, respectively, diameters of 22, 16 and 13 mm in a ratio of 3:2:1.

EXAMPLE 5

The device of FIGS. 7 and 8 is used for a wet milling process. The shafts of the vibrators 5''' rotate in the same direction and therefore impart onto the ore in the working cell 1''' a rotary-vibratory motion. The ore is subjected by the working cell 1''' to a self-milling operation. This self-milling causes the particles of the ore to strike each other and thereby disintegrate each other. Kaolin ore containing kaolinite and sand is fed into the working cell 1''' to the inlet chute **10*a'''*. Water is similarly fed into the working cell 1'''. The water wets the clay component of the ore and by virtue of the self-milling the kaolinite is concentrated and removed by flotation through the overflow pipes 11*a*. The pure sand of the kaolin ore continues to rotate in the working cell 1''' and moves toward and is discharged by the tangentially projecting outlet pipe 13**. Out of an ore containing 21.7 wt % $Al_2O_3$ there can be obtained sand with a content of 2.7 wt % of $Al_2O_3$ and the kaolin separated by flotation has a content of 27.8 wt % of $Al_2O_3$.

This application is related to application Ser. No. 572,342 filed Apr. 28, 1975 and entitled VIBRO-ACOUSTICAL EXTRACTION APPARATUS, application Ser. No. 572,095 filed Apr. 28, 1975 and entitled METHOD AND APPARATUS FOR EMULSIFICATION and application Ser. No. 572,457 filed Apr. 28, 1975 and entitled MATERIAL TREATING APPARATUS INCLUDING PNEUMOHYDRAULIC VIBRATOR, all co-assigned with the instant application and filed on behalf of Stoycho Stoev et al.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

What is claimed is:

1. In a combined milling, flotation and size classifying apparatus for a graded-size particulate charge, the apparatus including a milling chamber containing a flotation liquid and a particulate milling medium, means for selectively introducing the charge into the chamber, means for selectively introducing air into the chamber below the level of the flotation liquid to form, with small-size particles of the charge released when the chamber is agitated, a froth that floats to the top of the liquid, and means for agitating the chamber; the improvement for more efficiently milling and classifying a brittle-type charge, wherein the milling medium comprises elastomeric bodies, and in which the agitating means comprises means for imparting a rapid vertical vibration to the chamber to uniformly disperse the air introduced therethrough throughout the chamber and to thereby increase the efficiency of the froth-production process, and comprising first outlet means on said milling chamber for removing a froth having floatable component particles of said particulate charge, whereby said vibrating milling chamber causes said elastic milling bodies to mill said particulate material, the floatable particles of said milled charge thereafter being removed from said milling chamber with said froth to which they adhere through said first outlet, a second outlet in the bottom portion of said milling chamber for removing the coarser component particles of said mineral ore from said milling chamber, and a first screen mounted in said working cell below said mass of elastic milling bodies and above said second outlet.

2. The apparatus as set forth in claim 1, including a second screen mounted in said milling chamber below said inlet means and said first outlet means but above said mass of elastic milling bodies.

* * * * *